United States Patent [19]

Cripps

[11] Patent Number: 4,739,289

[45] Date of Patent: Apr. 19, 1988

[54] MICROSTRIP BALUN HAVING IMPROVED BANDWIDTH

[75] Inventor: Stephen C. Cripps, Sunnyvale, Calif.

[73] Assignee: Celeritek Inc., San Jose, Calif.

[21] Appl. No.: 933,820

[22] Filed: Nov. 24, 1986

[51] Int. Cl.[4] ..... H01P 5/10

[52] U.S. Cl. ..... 333/26; 333/238

[58] Field of Search ..... 333/26, 238, 246, 116

[56] References Cited

U.S. PATENT DOCUMENTS

| | | | |
|---|---|---|---|
| 3,093,805 | 6/1963 | Osifchin et al. | 333/238 X |
| 3,575,674 | 4/1971 | Howe, Jr. | 333/116 |
| 3,835,421 | 9/1974 | DeBrecht et al. | 333/26 |
| 3,975,690 | 8/1976 | Fleming | 333/246 X |

FOREIGN PATENT DOCUMENTS

| | | | |
|---|---|---|---|
| 148405 | 8/1984 | Japan | 333/26 |

*Primary Examiner*—Paul Gensler

*Attorney, Agent, or Firm*—Flehr, Hohbach, Test, Albritton & Herbert

[57] ABSTRACT

A microstrip balun comprises a ceramic substrate having a ground plane on one surface and three elongated conductive strips on the opposite surface. First ends of the outer strips are interconnected with the ground plane through vias in the substrate. The unbalanced signal input is applied to the ground plane near the vias and one end of the inner strip. The other ends of the outer strips are interconnected, and the balanced signal output is taken at this interconnection and at one end of the inner strip. A portion of the ground plane beneath portions of the strips can be removed.

5 Claims, 1 Drawing Sheet

MICROSTRIP BALUN HAVING IMPROVED BANDWIDTH

This invention relates generally to passive microstrip structure and more particularly the invention relates to a microstrip balun device for transforming an unbalanced microwave signal into a balanced microwave signal.

In RF signal transmission lines, the load at a feed point can be unbalanced as in a coaxial feed line where one terminal is grounded or balanced where both terminals of the feed point are symmetrical. A device for transforming an unbalanced signal to a balanced signal is called a balun. The balun isolates the unbalanced load from the balanced line while providing efficient power transfer.

Baluns have heretofore been realized in coaxial form or have used multilayer striplike structures, both of which are incompatible with microwave integrated circuit technology. Attempts at making baluns which can be realized in the microstrip environment have resulted in devices having a usable bandwidth of only a few tens of percentage.

The present invention is directed to a new microstrip balun structure which has usable bandwidth of several hundreds of percentage. An unbalanced input signal is connected to the device which consists of a number of parallel coplanar strips of metallic conductor situated on top of a layer of dielectric material. The ground connector to the unbalanced input signal is achieved using plated-through holes which connect a number of the strips on the top surface to a conductive ground plane underneath the dielectric layer. A balanced output signal is obtained from the output of the device due to the interaction of the coupling properties of the multiple strips.

A feature of the invention is the utilization of the coupling properties of coplanar strips in a manner which causes the input signal to split into two essentially equal amplitude signals, which are in antiphase with each other at the output of the device.

The invention and objects and features thereof will become more readily apparent from the following detailed description and appended claims when taken with the drawing, in which:

Figure 1:
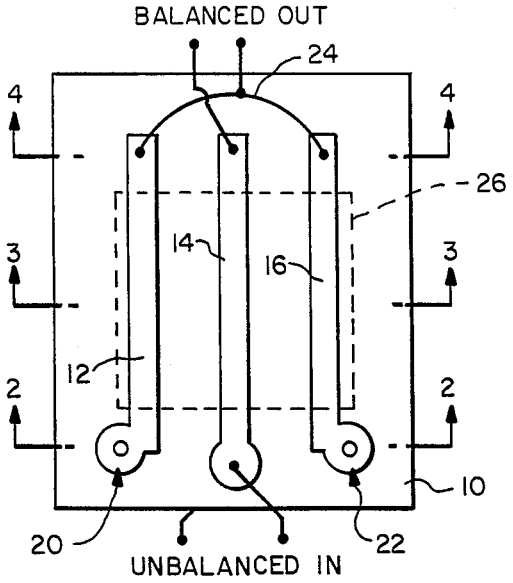
FIG. 1 is a top plan view of a microstrip balun in accordance with one embodiment of the invention.

Referring now to the drawings, FIG. 1 is a top plan view of a microstrip balun in accordance with one embodiment of the invention. The balun comprises a ceramic body 10 having parallel conductive lines 12, 14 and 16 plated on a top surface thereof. The lines 12 and 16 are interconnected with a ground plane conductive layer 18 (FIG. 2) through plated-through holes or vias 20 and 22. The opposite ends of the strips 12 and 16 are electrically interconnected by a bonded wire 24 or other suitable interconnection means.

Figure 3:
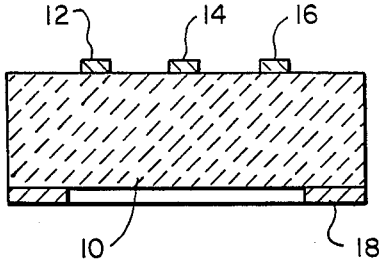
FIG. 3 is a section view of the balun of FIG. 1. taken along the line 3—3.
Figure 2:
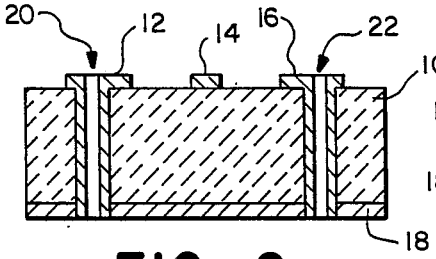
FIG. 2 is a section view of the balun of FIG. 1 taken along the line 2—2.
Figure 4:
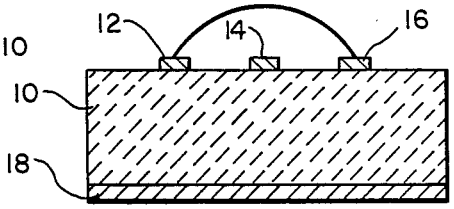
FIG. 4 is a section view of the balun of FIG. 1 taken along the line 4—4.

FIG. 2 is a section view of the balun of FIG. 1 taken along the line 2—2 and further illustrates the vias 20 and 22 which interconnect strips 12 and 16 with the ground plane 18. FIG. 3 is a section view of the balun taken along the line 3—3, and FIG. 4 is a section view of the balun taken along the line 4—4 of FIG. 1.

As noted in FIG. 3, a central portion of the ground plane 18 is removed as illustrated by the dotted line 26 in FIG. 1. The removed section of the ground plane 18 can improve the performance of the balun under certain conditions, but its use and deployment are not a fundamental part of the invention.

In operation, the grounded half of an unbalanced signal is connected to the ground plane at the end of the device where the vias 20, 22 are located, and the other half of the unbalanced signal is connected to the conductive strip 14 at the end near the vias. A balanced signal is obtained at the opposite end from the interconnected strips 12 and 16 and the center strip 14. The inner strip 14 and the outer strips 12, 16 together form a balanced transmission line whose characteristic impedance is arranged to be the same as the characteristic impedance of the microstrip source and load terminations. Balun action is achieved through the essentially complete transfer of the energy of the input unbalanced signal into the balanced transmission line. In order for this transfer to be achieved over a wide range of frequencies, it is essential that the unbalanced transmission line bound by each individual strip to the ground plane be of the highest possible effective characteristic impedance. In accordance with a feature of the invention, the aforementioned characteristic impedance, or even mode impedance, of the inner strip is many times higher than the same individual strip in isolation due to the "guarding" effect of the adjacent outer strips. The use of the multistrip structure to multiply up the effective even mode impedance of the inner strip is a distinguishing feature of the invention as compared to the use of multistrip structures in conventional microwave couplers.

Figure 5:
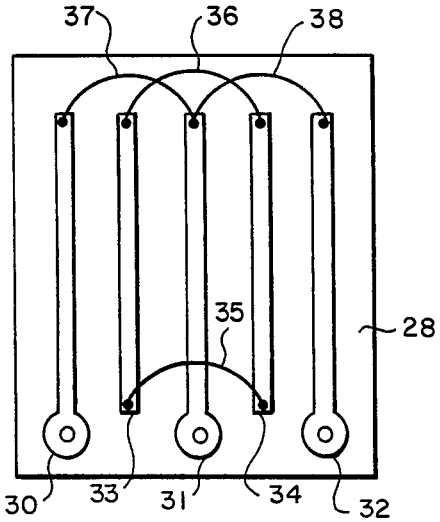
FIG. 5 is a top plan view of a microstrip balun in accordance with another embodiment of the invention.

FIG. 5 is a top plan view of an alternative embodiment of the invention in which five strips 30–34 are provided on the top surface of a ceramic substrate 28 with one end of each of the strips 30, 31 and 32 interconnected with the bottom ground plane through vias and the other two strips 33 and 34 interconnected by a wire bond 35 at the end of the device where the vias are located. At the opposite end of the device the strips 30, 31 and 32 are electrically interconnected by the wire bonds 37, 38, and the strips 33 and 34 are interconnected by the wire bond 36. The input signal is applied to the ground plane and to the wire bond 35, and the output signal is taken between the wire bond 36 and the interconnected wire bonds 37, 38. In this embodiment, the two strips 33 and 34 are guarded by the adjacent strips 30, 31 and 32.

A specific embodiment of the device of FIG. 1 for an operating bandwidth of 3–12 GHz is as follows:

Substrate material—alumina ($Al_2O_3$)
Substrate thickness—15 mils.
Inner strip 14 width—3 mils.
Outer strips 12, 16 width—2.5 mils.
Length of strips—200 mils.

Removal of the ground plane beneath the strips reduces capacitance and increases the operating bandwidth of the balun.

There has been described a new microstrip balun having improved operating characteristics including usable bandwidth. While the invention has been described with reference to specific embodiments, the description is illustrative of the invention and not to be construed as limiting the invention. Various modifications and applications may occur to those skilled in the art without departing from the true spirit and scope of the invention as defined by the appended claims.

I claim:

1. A microstrip balun for transforming an unbalanced microwave signal to a balanced microwave signal comprising a body of electrically insulating material having a top surface and a bottom surface, a layer of conductive material on said bottom surface and functioning as a ground plane, a first elongated strip of conductive material on said top surface, second and third elongated strips of conductive material on said top surface, said first elongated strip being positioned between and spaced from said second and third elongated strips, means interconnecting first ends of said second and third elongated strips to said layer of conductive material, means interconnecting opposite ends of said second and third elongated strips opposite from said first ends, means for applying an unbalanced signal between said ground plane and one end of said first elongated strip near said first ends of said second and third elongated strips, and means for receiving a balanced signal from said opposite ends of said second and third elongated strips and the end of said first elongated strip opposite said one end.

2. A microstrip balun as defined by claim 1 wherein said means interconnecting said first ends of said second and third elongated strips to said layer of conductive material comprises plated-through holes extending through said body.

3. A microstrip balun as defined by claim 1 and further including fourth and fifth elongated strips of conductive material on said top surface with said fourth strip being positioned between and spaced from said third elongated strip and said fifth elongated strip, means interconnecting one end of said fifth elongated strip to said layer of conductive material, means interconnecting the end opposite from said one end of said fifth conductive strip to said opposite end of said third conductive strip, means interconnecting one end of said fourth conductive strip to said one end of said first conductive strip, and means interconnecting the other ends of said fourth conductive strip and said first conductive strip.

4. A microstrip balun as defined by claim 3 wherein a portion of said layer of conductive material is removed from said bottom surface beneath portions of said elongated strips.

5. A microstrip balun as defined by claim 1 wherein a portion of said layer of conductive material is removed from said bottom surface beneath portions of said elongated strips.

* * * * *